US006848941B2

(12) United States Patent
Wlos et al.

(10) Patent No.: US 6,848,941 B2
(45) **Date of Patent: *Feb. 1, 2005**

(54) LOW COST, HIGH PERFORMANCE CABLE-CONNECTOR SYSTEM AND ASSEMBLY METHOD

(75) Inventors: James Wlos, Crete, IL (US); James Krabec, Oak Lawn, IL (US)

(73) Assignee: Andrew Corporation, Orlando Park, IL (US)

( * ) Notice: Subject to any disclaimer, the term of this patent is extended or adjusted under 35 U.S.C. 154(b) by 9 days.

This patent is subject to a terminal disclaimer.

(21) Appl. No.: 10/249,112

(22) Filed: Mar. 17, 2003

(65) Prior Publication Data

US 2004/0161970 A1 Aug. 19, 2004

Related U.S. Application Data

(63) Continuation-in-part of application No. 10/248,741, filed on Feb. 13, 2003.

(51) Int. Cl.[7] ..... H01R 17/04
(52) U.S. Cl. ..... 439/585; 434/578
(58) Field of Search ..... 439/585, 578–584, 439/684, 675, 932

(56) References Cited

U.S. PATENT DOCUMENTS 4,990,106 A * 2/1991 Szegda ..... 439/585
5,141,451 A * 8/1992 Down ..... 439/585
5,154,636 A * 10/1992 Vaccaro et al. ..... 439/583
5,281,167 A * 1/1994 Le et al. ..... 439/578
5,518,420 A * 5/1996 Pitschi ..... 439/578
5,977,484 A * 11/1999 Jones et al. ..... 174/135
6,575,786 B1 * 6/2003 Khemakhem et al. ..... 439/580

* cited by examiner

*Primary Examiner*—Hien Vu
(74) *Attorney, Agent, or Firm*—Babcock IP, LLC

(57) ABSTRACT

A cable-connector system advantageously used with flexible, relatively small diameter coaxial cable and connectors, including a coaxial cable with a foam dielectric surrounding an inner conductor; and a tubular outer conductor surrounding the foam dielectric, the outer conductor being composed of aluminum or aluminum alloy and having helical corrugations; and a connector, having: a connector body having a hollow bore with internal perturbations keyed to the helical corrugations and arranged to retentively receive and secure the connector on the cable when the connector is screwed onto the cable with the corrugations engaging the perturbations; the connector body having a crimp section adapted to be compressed by a connector crimping tool; the crimp section configured such that when crimped, the crimp section deforms inwardly and distorts the cable outer conductor corrugations to prevent relative rotation between the cable and the connector body and interlock the connector and cable.

66 Claims, 9 Drawing Sheets

LOW COST, HIGH PERFORMANCE CABLE-CONNECTOR SYSTEM AND ASSEMBLY METHOD

CROSS REFERENCE TO RELATED APPLICATIONS

This application is a continuation-in-part of application Ser. No. 10/248,741, filed Feb. 13, 2003, owned by the assignee of the present application, Andrew Corporation of Orland Park, Ill.

BACKGROUND OF INVENTION

1. Field of the Invention

The invention relates to an improved cable-connector system, and more particularly to a system comprising: 1) a low cost, high performance, water blocking aluminum cable as described in U.S. utility patent application Ser. No. 10/131,747 filed Apr. 24, 2002 also assigned to Andrew Corporation and hereby incorporated by reference in its entirety, and 2) a low cost, high performance water-blocking connector uniquely configured to mate with such low cost aluminum cable.

As described in detail in the '747 application, no known cable product exists which met all four of the desired foam coaxial cable attributes: 1) low cost comparable to braided cable cost; 2) electrical properties including shielding effectiveness and intermodulation suppression comparable to that of solid tubular shielded cable; 3) mechanical properties, primarily flexibility, comparable to braided cable; and 4) water blockage comparable to annular corrugated cable.

The unique capabilities of the aforesaid cable were achieved by a novel combination of cable materials, manufacturing methods and cable structural configurations. The very low cost of the cable was achieved in part by the use of an outer conductor composed of aluminum or aluminum alloy. The use of aluminum provides enhanced water blockage by permitting the helical outer conductor during formation to be permanently deformed into the foam insulator material, thus eliminating air gaps at the corrugation crests of the cable and providing a moisture seal.

The manufacturing cost of the cable was dramatically reduced in part by using a dual lead helix on the corrugation, permitting the cable line speed to be doubled. One aspect of the present invention is to provide a connector for such a cable which complements the cable by offering low cost of manufacture, excellent electrical performance and moisture blockage, secure cable retention, and superior ease and speed of field installation.

The unique dual lead helical corrugations and aluminum construction of the cable outer conductor presents first-ever challenges to the connector designer. The dual helical corrugation creates two separate and independent helical grooves which must each be sealed to prevent moisture migration. The use of aluminum as the material for the outer conductor, being much softer and more ductile than conventional copper and copper alloys, has to be treated differently in designing a crimp type connector to prevent over deformation of the outer conductor which could degrade electrical performance of the cable.

To better understand the construction of a dual lead helical cable corrugation, reference may be had to FIGS. 12 and 13. A single lead coaxial cable 175 is depicted in FIG. 12. The single lead coaxial cable 175 of FIG. 12 has an inner conductor 220, a dielectric foam insulator 210 that surrounds the inner conductor 220, and an outer conductor 200 surrounding the foam insulator dielectric 210. The outer conductor 200 has single lead corrugations 195 which compress the foam insulator dielectric 210. The single lead coaxial cable 175 may also have a jacket 190 that surrounds the outer conductor 200. The angle 196 is the pitch angle of the outer conductor 200 corrugations.

A dual lead coaxial cable 180 of the type preferred for use in the system of the present invention is depicted in FIG. 13. The dual lead coaxial cable 180 of FIG. 13 also has an inner conductor 220, a foam insulator dielectric 210 that surrounds the inner conductor 220, and an outer conductor 200 surrounding the dielectric 210. The outer conductor 200 may be a thin strip of ductile material with a longitudinal high frequency weld seam. The outer conductor 200 has dual lead corrugations 197 which tightly compress the dielectric 210. The compression of the dielectric 210 substantially eliminates the formation of fluid propagating air gaps and passageways between the outer conductor 200 and the dielectric 210. The dual lead coaxial cable 180 may also have a jacket 190 that surrounds the outer conductor 200. The angle 198 is the pitch angle of the outer conductor dual lead corrugations 197 which is twice the pitch angle of a single lead helical corrugation 196.

It will be understood from FIGS. 12 and 13 that dual lead helical corrugations are in essence two interposed single lead corrugations. As suggested, this creates two separate helical grooves along the cable which must be closed to block invasion and migration of moisture into the connector.

The chief competition for the novel cable-connector system of the present invention is the various braided cable systems. Braided cable suffers from electrical and water blockage performance which is inferior to the low cost corrugated cable described. Further, as will become evident from the ensuing description of the connector of the present invention, braided cable connectors are much more difficult to attach to the cable, requiring elaborate cable preparation in some cases. They are more expensive to manufacture than the present connector as they all require that the connector body provide an inner ferrule against the electrically conductive braid or foil is compressed to retain the connector on the cable. Means for moisture-blocking the connector may be integrated into or separate from the means for compressively securing the connector on the cable.

The connector of the present system, in contrast offers a relatively simple and low cost approach to securely installing the connector on the cable and preventing moisture invasion into the connector and attached cable. As will be described at length below, the connector of the present invention does not require an inner ferrule against which a braid or foil is compressed to hold the connector on the cable. In one embodiment, internal helical grooves formed in the hollow inner connector body of the connector enable the connector to be simply screwed onto mating corrugations of the cable outer conductor until the connector reaches a stop. To prevent the cable from inadvertently unscrewing or backing out, the connector body is crimped down on the corrugated outer conductor. This prevents the cable from rotating while in use or during assembly, solidly locking the connector permanently onto the cable.

In other embodiments, the internal bore of the connector body which receives the corrugated cable body may be ribbed longitudinally or circumferentially, roughened or otherwise perturbed in other ways such that when the connector body is crimped down on the outer conductor of the cable, it cannot unscrew or otherwise back out.

In preferred embodiments, as will be explained, the connector body is provided with radial external ribs which reduce and control the amount of force required to deform the connector body. The crimping of the connector body is accomplished with a conventional crimping tool having a hexagonal clamp opening.

In accordance with a feature of the present invention, because of the use of the connector with a cable having a an outer conductor composed of soft, ductile aluminum or aluminum alloy, the ribs may be varied in length and/or width to define a deformation profile on the connected cable which permanently secures the cable in the connector, but also optimizes electrical performance and moisture blockage.

The connector component of the system will now be described in detail. It should be understood that while the connector is most advantageously used with the described low-cost cable having a dual lead helically corrugated aluminum outer conductor, the connector may be employed also with other corrugated cables.

2. Description of Related Connector Prior Art

Connectors for corrugated outer conductor cable are used throughout the semi-flexible corrugated coaxial cable industry.

Competition within the cable and connector industry has increased the importance of minimizing installation time, required installation tools, and connector manufacturing/materials costs.

Previously, connectors have been designed to attach to coaxial cable using solder, and or mechanical compression. The quality of a solder connection may vary with the training and motivation of the installation personnel. Solder connections are time consuming and require specialized tools, especially during connector installation under field conditions. Mechanical compression connections may require compressive force levels that are excessive for field installation, and or special tooling that may not be portable or commercially practical for field installation use. Mechanical compression designs using wedging members compressed by tightening threads formed on the connector may be prohibitively expensive to manufacture.

The corrugation grooves of helically corrugated coaxial cable may provide a moisture infiltration path(s) into the internal areas of the connector and cable interconnection. The infiltration path(s) may increase the chances for moisture degradation and or damage to the connector, cable, and or the connector and cable interconnection. Previously, O-rings or lip seals between the connector and the cable outer conductor and or jacket have been used to minimize moisture infiltration. O-rings may not fully seat/seal into the bottom of the corrugations and lip seals or O-rings sealing against the jacket may fail over time if the jacket material deforms.

Heat shrink tubing has been used to protect the connector and cable interface area and or increase the rigidity of the connector/cable interconnection. However, the heat shrink tubing may not fully seal against the connector body, increasing the moisture infiltration problems by allowing moisture to infiltrate and then pool under the heat shrink tubing against the outer conductor seal(s), if any.

Therefore, it is an object of the invention to provide a coaxial connector that overcomes deficiencies in the prior art.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1A:
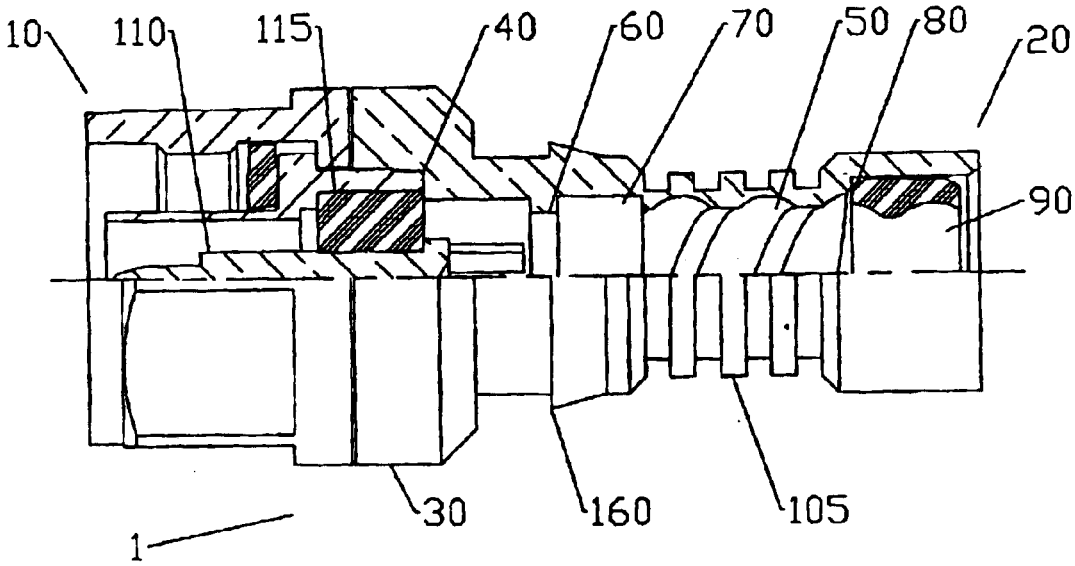
FIG. 1*a* shows an external side and partial section view of an embodiment of the invention having an internal crimp area helical grooved section.
Figure 3:
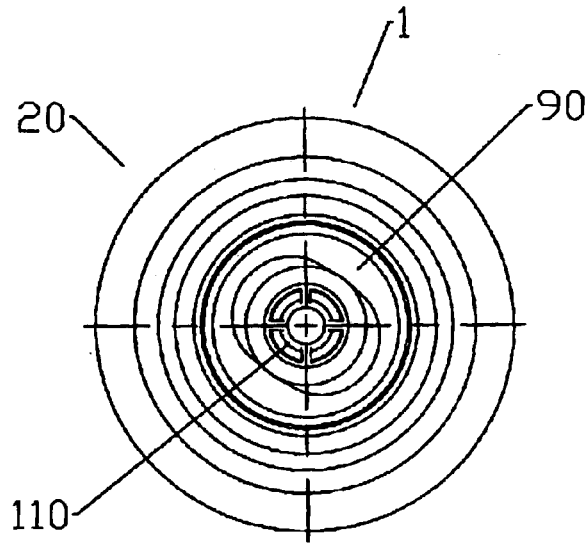
FIG. 3 shows an external cable end view of the embodiment of the invention shown in FIG. 1.
Figure 11:
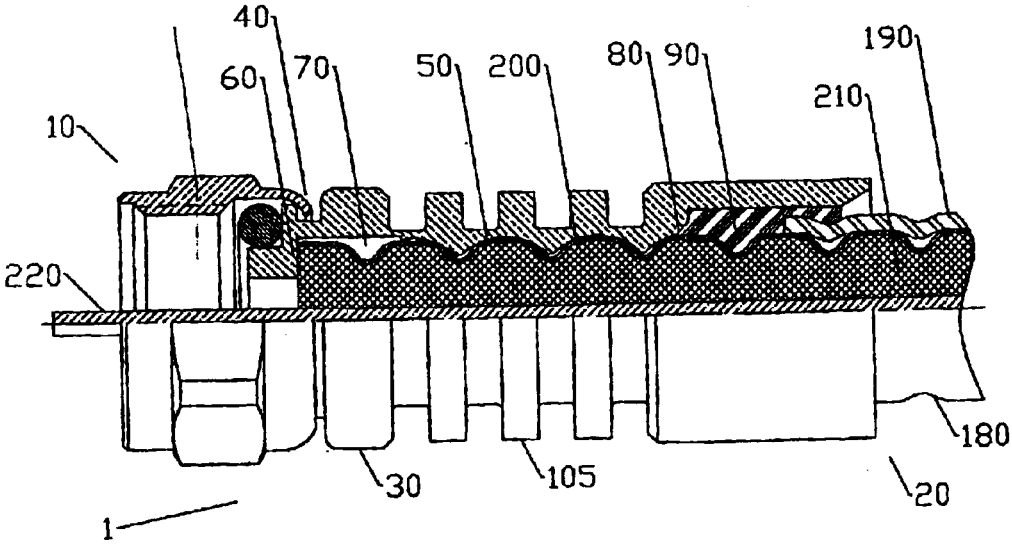
FIG. 11 shows an external side and partial section view of an embodiment of the invention dimensioned for a type F or CATV type connector, also showing a cable within the connector.

One embodiment of a crimp connector, for example a type N connector, is shown in FIG. 1*a*. The crimp connector 1 has a connector end 10 (FIG. 2) and a cable end 20 (FIG. 3). The specific form or connector interface of connector end 10 may depend on the coaxial cable diameter and or the application the crimp connector and selected coaxial cable is intended for. The connector end 10 of the crimp connector may be configured with a connector interface selected to mate with any type of connector mounted on a device or other cable using, for example, standard type F, BNC, SMA, DIN, UHF, CATV, EIA, or a proprietary connector interface configuration. Dimensions and or configuration of the crimp connector 1 at the connector end 10 that form the desired standardized connector type are known in the art. A connector end 10 in a type N connector interface configuration is shown in FIGS. 1*a*–1*e*, 2 and 3. A type F and or CATV connector interface configuration is shown in FIG. 11.

Figure 4A:
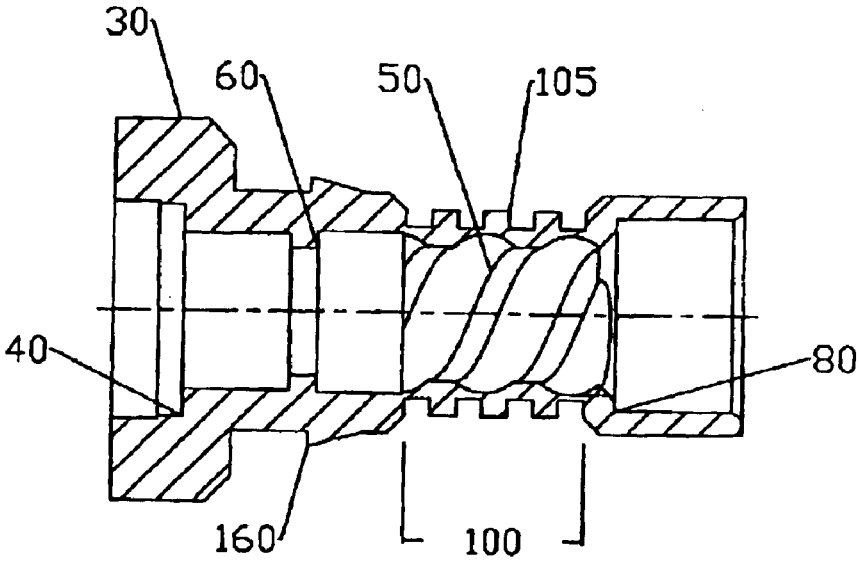
FIG. 4*a* shows a section side view of a body portion of the embodiment of the invention shown in FIG. 1.
Figure 4B:
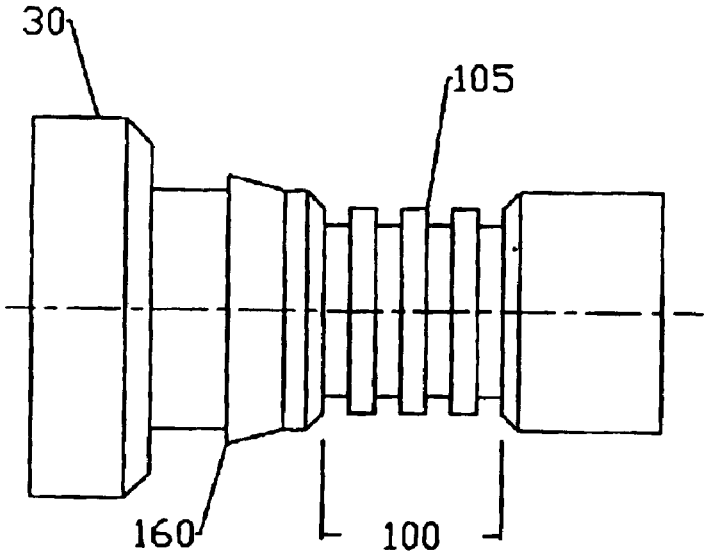
FIG. 4*b* shows an external side view of a body portion of the embodiment of the invention shown in FIG. 1.
Figure 5A:
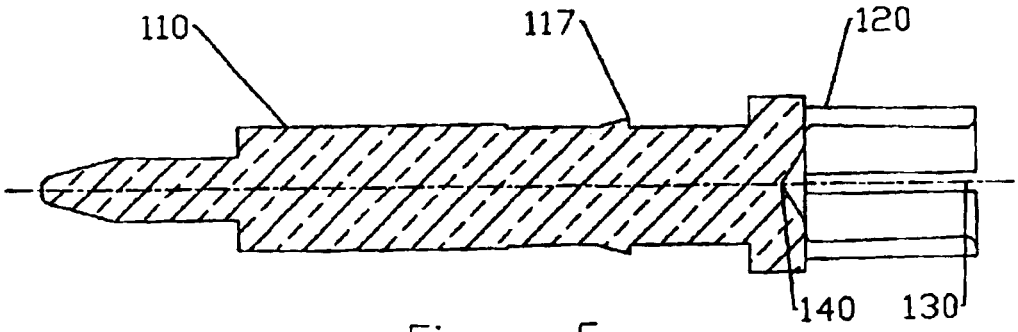
FIG. 5*a* shows a side section view of an inner contact of the embodiment of the invention shown in FIG. 1.
Figure 5B:
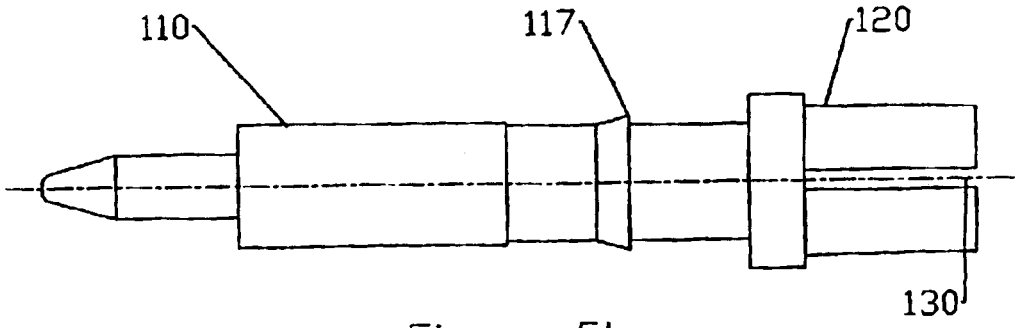
FIG. 5*b* shows an external side view of an inner contact of the embodiment of the invention shown in FIG. 1.
Figure 6:
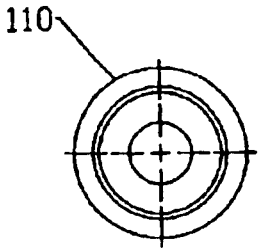
FIG. 6 shows an external connector end view of the inner contact shown in FIGS. 5*a* and 5*b*.

As shown in FIGS. 4*a* and 4*b*, a body 30 forms the outer shell of the cable end 20. The body 30 may have a connector end annular shoulder 40 for receiving and retaining via, for example an interference fit, the connector end 10. In the case of smaller dimensioned connectors, for example a type F or CATV connector as shown in FIG. 11, the annular shoulder 40 may be formed as a radial groove into which the connector end 10 may be rotatably attached by, for example, metal stamping or swaging.

Figure 1B:
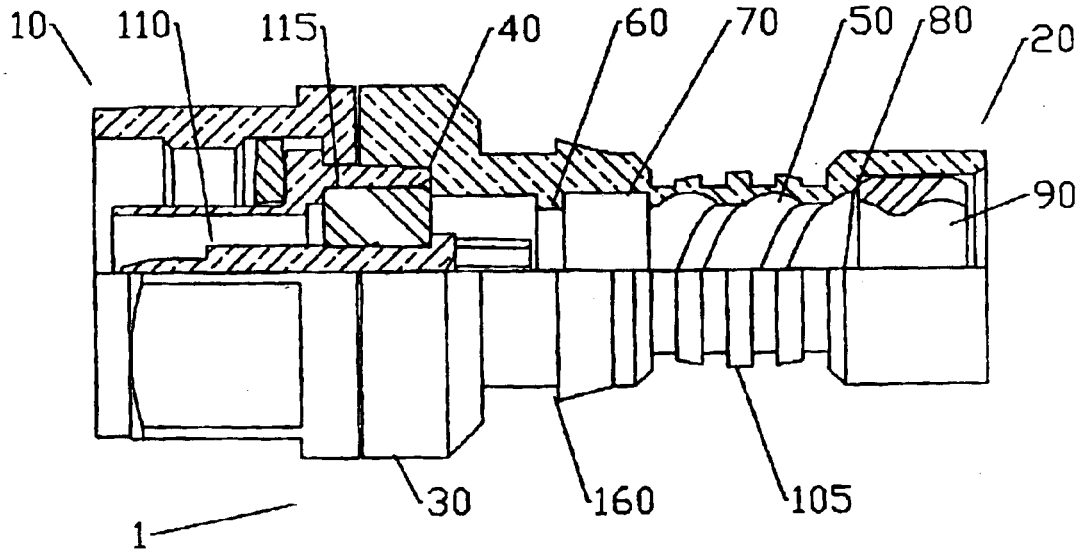
FIG. 1*b* shows an external side and partial section view of an embodiment of the invention having varied height crimp area ridges.
Figure 1C:
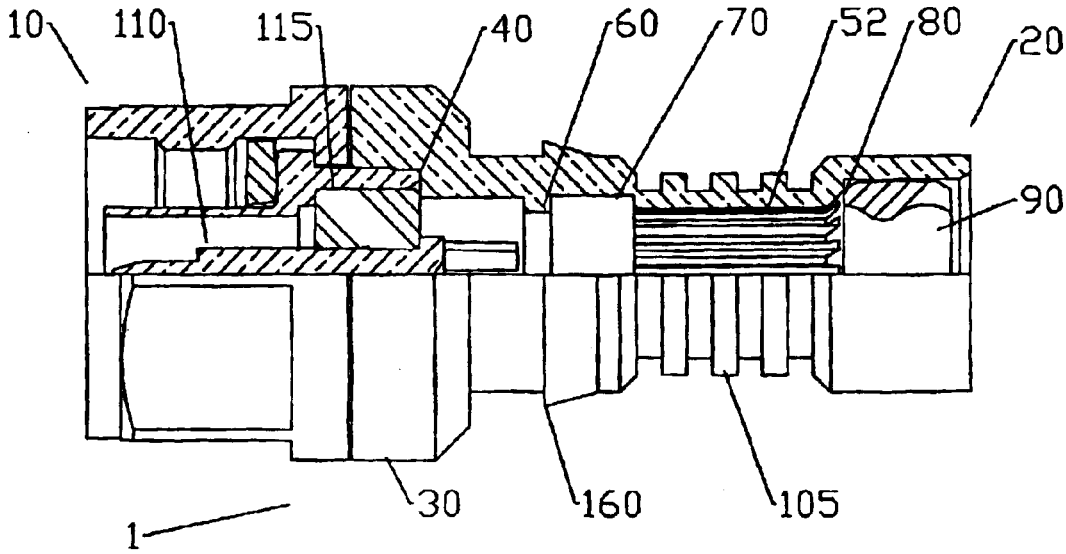
FIG. 1*c* shows an external side and partial section view of an embodiment of the invention having internal crimp area axial grooves.
Figure 1D:
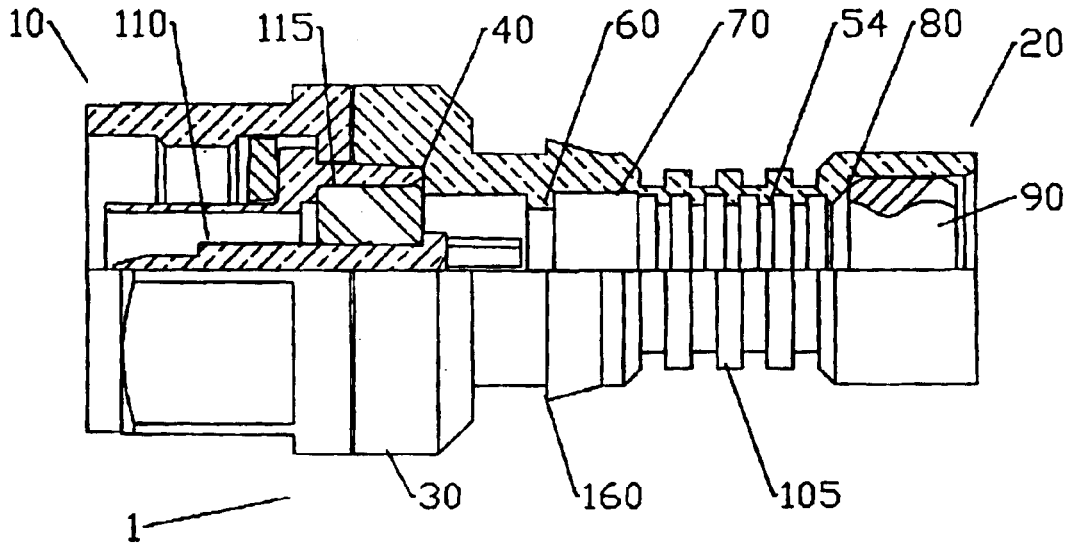
FIG. 1*d* shows an external side and partial section view of an embodiment of the invention having internal crimp area radial grooves.
Figure 1E:
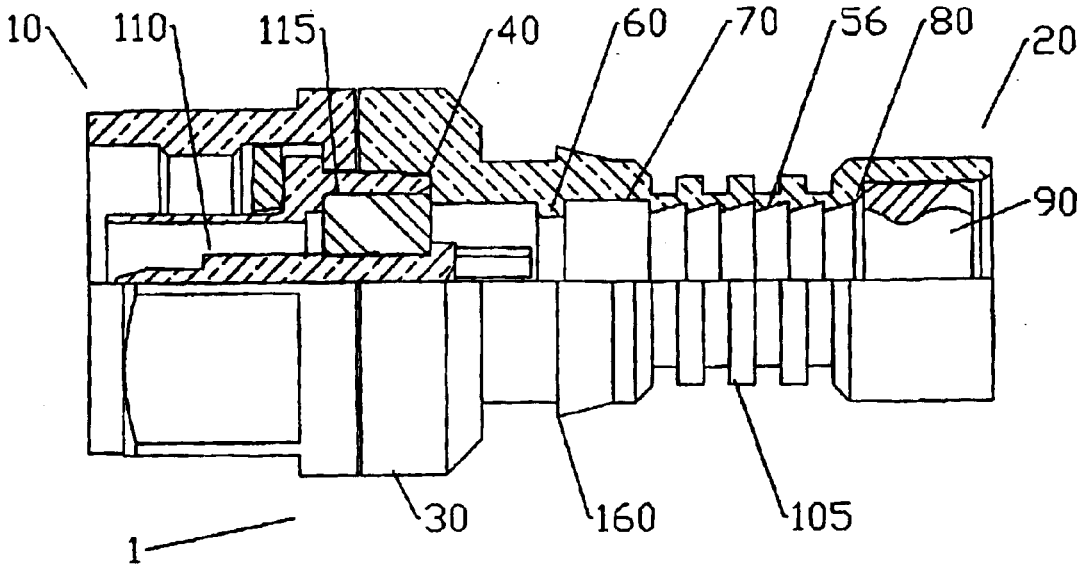
FIG. 1*e* shows an external side and partial section view of an embodiment of the invention having internal crimp area radial ridges.
Figure 1F:
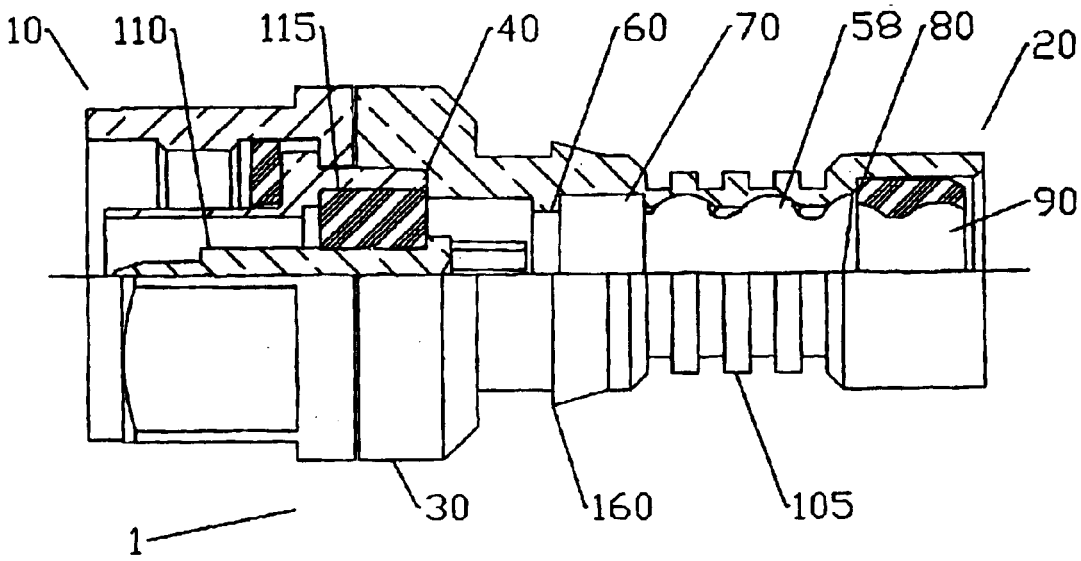
FIG. 1*f* shows an external side and partial section view of an embodiment of the invention having internal crimp area perturbations.
Figure 2:
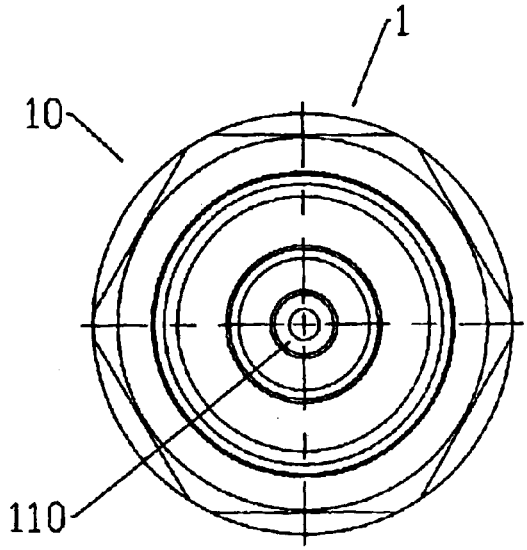
FIG. 2 shows an external connector end view of the embodiment of the invention shown in FIG. 1.

As previewed above, a helical groove section 50 of the embodiments shown in FIGS. 1*a*, 1*b*, 4*a* and 11 preferably mates with exterior configurations and dimensions of a dual lead helical corrugated outer conductor 200 of a dual lead coaxial cable 180 as described in U.S. utility patent application Ser. No. 10/131,747 filed Apr. 24, 2002. The helical grooves may be formed from continuous, threadlike, grooves or helical shaped rows of axially spaced bumps or other form of appropriately sized and spaced internal perturbations (FIG. 1*f*). Any form of internal perturbation which keys with the single or dual lead corrugations of the applicable single lead coaxial cable 175 or preferably dual lead coaxial cable 180 to enable threading of the cables into the helical groove section 50 and which then prevents axial removal without a corresponding unthreading may be used.

Figure 12:
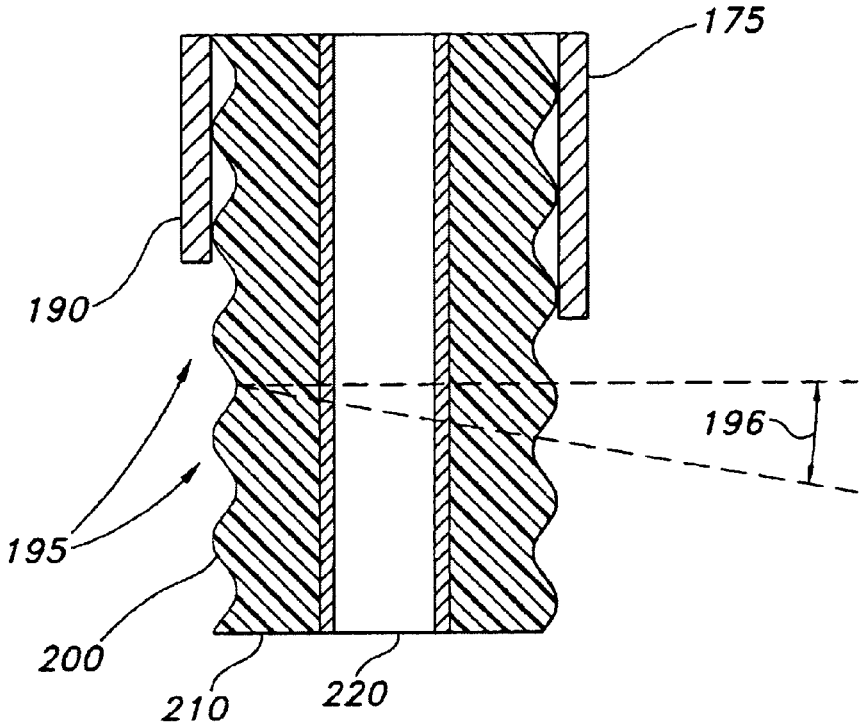
FIG. 12 is a cutaway schematic side view drawing depicting the various components of an embodiment of a single lead helical coaxial cable.
Figure 13:
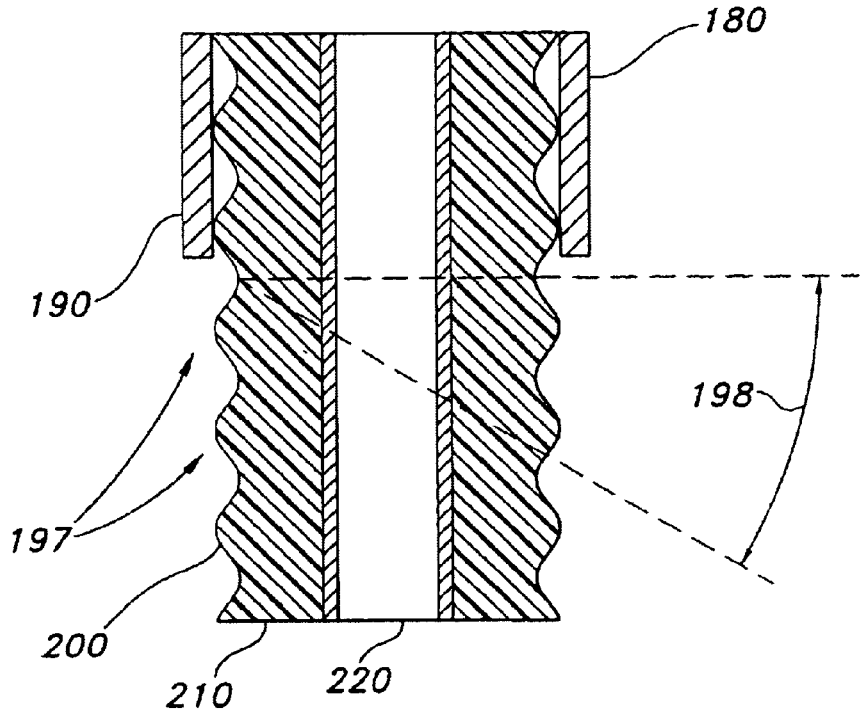
FIG. 13 is a cutaway schematic side view drawing depicting the various components of an embodiment of a dual lead helical coaxial cable.

The dual lead coaxial cable 180, as shown for example in FIG. 13, as generally described, above, may be dimensioned for various applications with, for example, 50 or 75 ohm impedance. The dual lead helical corrugation provides the dual lead coaxial cable 180 with advantageous strength, flexibility and weight characteristics. However, dual grooves that form the dual lead helical corrugation also increase the opportunity for moisture infiltration due to the presence of an additional groove, compared to a traditional single lead helical corrugation, as shown in FIG. 12.

The helical groove section 50 increases the contact surface area between the cable outer conductor 200 and the body 30 in the crimp area 100, thereby improving the electrical characteristics of the connection between the body 30 and the outer conductor 200. Also, during installation, the connector 1 is initially threadably retained upon the dual lead coaxial cable 180.

Although the helical groove section 50 is preferred for optimizing electrical interconnection, accurately forming the helical groove profile of the helical groove section 50 may require advanced machining equipment and or casting methods that may make the body 30 comparatively expensive for some applications and or connector types. Examples of simplified alternative mating section structures are shown in FIGS. 1*c*–1*e*. In FIG. 1*c*, a plurality of axial grooves 52 may be dimensioned to create an interference fit with the outer conductor 200 of the dual lead coaxial cable 180. Alternatively, as shown in FIG. 1*d*, radial grooves 54 may be used. FIG. 1*e* demonstrates an embodiment using a plurality of radial ridge(s) 56 where the dual lead coaxial cable 180 may be easily inserted against sloping faces of the radial ridge(s) 56 in the insertion direction towards the connector end 10 but backfaces generally tangential to the axial length of the connector 1 inhibit easy removal. Also, upon compression and or deformation (crimping) of the compression area 100, each of the alternative structures may be expected to securely grasp the outer conductor 200, increasing the reliability of the electrical connection between the dual lead coaxial cable 180 and the connector 1 and also inhibiting separation.

The body 30 may be formed from, for example brass or other metal alloy. To minimize corrosion and or dissimilar metal reactions with the connector end 10 and or the outer conductor 200 of the dual lead coaxial cable 180, the body 30 may have a corrosion resistant plating, for example, tin or chromium plating.

A cable end shoulder 80 may be added to the body 30 for seating a gasket 90 or an application of sealant, described herein below.

Compared with braided cable systems, the present invention facilitates rapid and foolproof field installation. A dual lead coaxial cable 180 may be prepared for attaching the crimp connector 1 by exposing an appropriate length of the cable's inner conductor 220 and by removing any outer jacket 190 from a section of the outer conductor 200. A gasket 90 may be screwed upon the outer conductor 200 and the crimp connector 1 may then be hand threaded onto the dual lead coaxial cable 180 until the cable's outer conductor 200 impacts upon a stop 60 that extends radially inward across the radial depth of the body 30. When the leading edge of the cable outer conductor 200 contacts the stop 60, further threading may partially collapse/compress the cable outer conductor corrugations into a deformation groove 70. The connector 1 is then electrically interconnected and physically secured upon the dual lead cable 180, without requiring field application of solder or conductive adhesive, by applying a crimp in the crimp area 100 sufficient to deform the internal helically grooved section 50 to a point where the dual lead cable 180 may not be unthreaded.

If alternatives to the helical grooved section 50, as shown for example in FIGS. 1*c*–1*e* are used, the connector 1 may be pressed and or screwed upon the similarly prepared dual lead coaxial cable 180, in an interference fit into the mating section, until the outer conductor 200 impacts the stop 60. However, unless a higher level of crimping force is applied, the alternatives may not produce the same resistance to separation once the connector 1 is crimped upon the dual lead coaxial cable 180, because the interlocking effect of the mating between the internal surface of the crimp area 100 and the, for example, dual lead corrugations 197 in the outer conductor 200 is reduced. Further, if too high a crimp force is applied, the spacing between the outer conductor 200 and the inner conductor 220 may be decreased to a point where the electrical characteristics of the dual lead coaxial cable 180 are degraded.

The outer diameter of the crimp area 100 may be adjusted to mate with, for example, industry standard hexagonal crimp hand tools by adjusting the radius and or width of the crimp area 100.

A plurality of ridges 105 may be formed in the crimp area 100. The depth and width of grooves between the ridges 105 may be selected to adjust the compressive force required to compress and or deform the, for example, internal helical groove section 50 and outer conductor 200 of the dual lead coaxial cable 180 during the crimp operation and also to create a corresponding retentive strength of the compressed material once crimped.

In alternative embodiments, the ridges 105 may be formed with varied heights for example to form a barrel shaped profile with a middle peak. As shown in FIG. 1*b*, ridges 105 having a lower depth at either end of the crimp area 100 and an increased height generally in the middle of the crimp area 100 may be formed to both tune the necessary compressive force and or to create a compression/deformation pattern of varied width and depth, once compression is applied over the crimp area 100.

Figure 7:
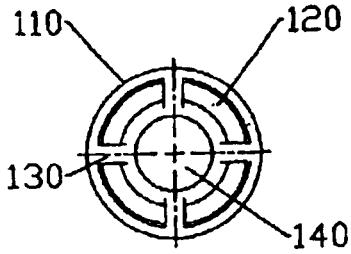
FIG. 7 shows an external cable end view of the inner contact shown in FIGS. 5*a* and 5*b*.
Figure 8A:
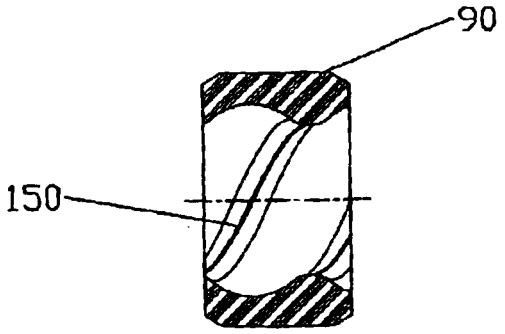
FIG. 8*a* shows a cross section view of a gasket of the embodiment of the invention shown in FIG. 1.
Figure 8B:
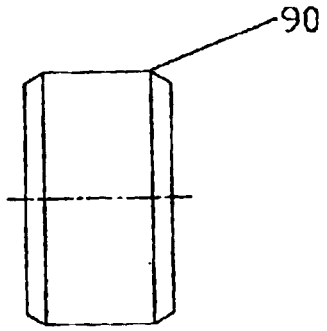
FIG. 8*b* shows an external side view of a gasket of the embodiment of the invention shown in FIG. 1.
Figure 9:
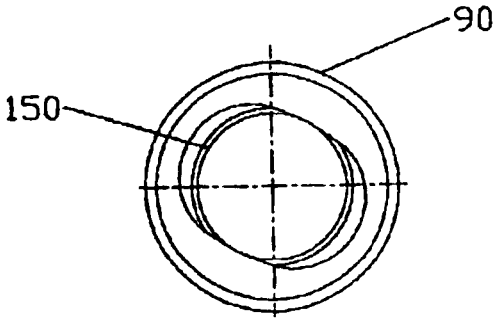
FIG. 9 shows an external cable end view of the gasket shown in FIGS. 8*a* and 8*b*.

During the threading of the connector 1 onto the helical corrugations in the outer conductor 200 of the dual lead coaxial cable 180, the inner conductor 220 is inserted into an inner contact 110 (FIGS. 5*a*–7). The inner contact 110 extends between the connector end 10 (FIG. 6) and the cable end 20 (FIG. 7). An insulator 115 may be mounted in the connector end 10 to locate the inner contact 110 coaxially spaced away from the body 30. A radial barb 117 or other structure on the inner contact 110 may be used to retain the inner contact 110 within the insulator 115.

A socket contact section 120 on the cable end 20 of the inner contact 110 may be formed with a cable end 20 diameter smaller than an outer diameter of the inner conductor 220. A plurality of slits 130 may be formed in the socket contact section 120 to allow the socket contact section 120 to easily flex and accommodate the inner conductor 220 upon insertion, creating a secure electrical connection without requiring, for example, soldering or conductive adhesive.

The inner contact 110 may be formed from a spring temper material, for example beryllium copper, phosphor bronze or other metal or metal alloy with suitable spring/flex characteristics. The inner contact 110 may be given a low contact resistance surface treatment, for example, gold or silver plating to increase conductive characteristics and negate dissimilar metal reactions with the center conductor of the dual lead coaxial cable and or other connectors. The appropriate length of exposed inner conductor 220, mentioned above, may be a length that results in the inner conductor 220 being inserted into the socket contact section 120 short of contacting a depression 140 when the outer conductor 200 of the dual lead coaxial cable 180 has fully seated against the stop 60 and any compression of the outer conductor 200 into the deformation groove 70 is completed.

As shown in FIG. 11, when the connector 1 is configured for use with some connector types, for example, a type F or CATV connector end 10, the inner contact 110 is not required. The dual lead coaxial cable 180 is prepared with a portion of the inner conductor 220 exposed so that it will extend through the body 30 to the connector end 10 when the dual lead coaxial cable 180 is mated with the connector 1.

Figure 10:
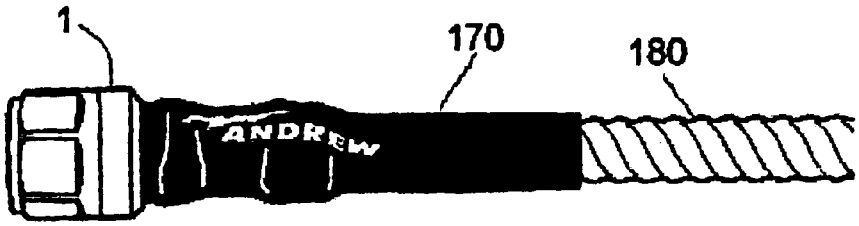
FIG. 10 shows an external side view of a connector according to one embodiment of the invention attached to a cable with heat shrink tubing applied to cover the interface between the cable and the connector.

As shown in FIG. 10, heat shrink tubing 170 may be applied over the body 30 and dual lead coaxial cable 180 interface as an additional environmental seal and to improve rigidity of the connection between the crimp connector 1 and the dual lead coaxial cable 180. The extended section of heat shrink tubing 170 covering the dual lead coaxial cable 180 creates an extended path through which moisture must pass to infiltrate the interconnection between the body 30 and the dual lead coaxial cable 180. However, the section of heat shrink tubing 170 over the body 30 is relatively short, creating an increased opportunity for moisture infiltration. To reduce this opportunity, an outward facing radial body barb 160 may be formed on the body 30. When the heat shrink tubing 170 is shrunk into place upon the body 30, the body barb 160 presents an acute contact surface that the heat shrink tubing 170 will tightly seal against and or around thereby reducing the opportunity for moisture infiltration and increasing the overall rigidity of the assembly.

As described, the crimp connector 1 provides the following advantages. The crimp connector 1 has a limited number of components and may be cost effectively assembled with only a few manufacturing operations. Further, the crimp connector 1 may be installed in the field, without requiring soldering or conductive adhesives, using only industry standard hand tools. Also, the crimp connector 1 may be used with dual lead coaxial cable 180 to form a cable/connector interconnection with a high level of moisture infiltration resistance. When heat shrink tubing 170 is applied to the crimp connector 1, an improved seal is created and the cable/connector interconnection has increased rigidity.

The cable-connector system of the present invention in its preferred execution offers a unique combination of features: 1) low manufacturing cost due to the low-cost dual lead helically corrugated aluminum cable and low-cost connector; 2) excellent moisture blockage attributable to the inherent superior moisture resistance of the cable, the dual lead helical groove compression gasket and unique high-surface-area, crimp-on-threads feature of the joint between the connector and cable; 3) permanent attachment of the connector and cable by the crimping of the connector onto a helically corrugated cable; 4) simplified and foolproof field installation enabled by the dry, secure, and unmistakable connection made with very few steps, minimal cable or connector preparation, lack of easy-to-lose extra parts and standard hand tools; and 5) excellent electrical performance.

Table of Parts

| | |
|---|---|
| 1 | crimp connector |
| 10 | connector end |
| 20 | cable end |
| 30 | body |
| 40 | connector end shoulder |
| 50 | helical groove section |
| 52 | axial grooves |
| 54 | radial grooves |
| 56 | raidal ridges |
| 58 | internal protrusions |
| 60 | stop |
| 70 | deformation groove |
| 80 | cable end shoulder |
| 90 | gasket |
| 100 | crimp area |
| 105 | ridge |
| 110 | inner contact |
| 115 | insulator |
| 117 | inner contact barb |
| 120 | socket contact section |
| 130 | slits |
| 140 | depression |
| 150 | thread |
| 160 | body barb |
| 170 | heat shrink tubing |
| 175 | single lead coaxial cable |
| 180 | dual lead coaxial cable |
| 190 | jacket |
| 195 | single lead corrugations |
| 196 | angle (single lead pitch) |
| 197 | dual lead corrugations |
| 198 | angle (dual lead pitch) |
| 200 | outer conductor |
| 210 | dielectric |
| 220 | inner conductor |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

What is claimed is:

1. A connector for coaxial cable having a helically corrugated outer conductor and an inner conductor, comprising:

a connector interface at a connector end side of the connector, coupled to a hollow cylindrical body with an inner surface having an internal helical groove section at a cable end side of the connector and a stop in the hollow cylindrical body proximate the connector end side of the internal helical groove section which extends radially inward, a deformation groove between the stop and the internal helical groove section;

the internal helical groove section and the stop configured to mate with the helically corrugated outer conductor, whereby the body is threadable onto the outer conductor until the outer conductor contacts the stop;

the body having a plurality of ridges on an outer surface of the body axially aligned with the internal helical groove section; and an inner contact located coaxially within the body, the inner contact having a socket contact section at the cable end side, dimensioned for insertion of the inner conductor and electrical connection therewith.

2. The connector of claim 1, further including a cable end shoulder between the helical groove section and the cable end side of the connector.

3. The connector of claim 2, further including a gasket, located in the cable end shoulder.

4. The connector of claim 3, wherein the gasket has an internal surface configured to mate with the helical corrugations of the outer conductor.

5. The connector of claim 3, wherein the gasket is one of neoprene, EPDM, silicone and nitrite material.

6. The connector of claim 1, wherein the socket contact section has a radius that decreases towards the cable end side.

7. The connector at claim 1, wherein the socket contact section has a plurality of slits.

8. The connector of claim 1, wherein the ridges have a height and a width whereby the helical groove section is crimpable by a crimping force generatable by a hand operated crimping tool.

9. The connector of claim 1, further including a retaining barb located on the outer surface at the connector end side of the plurality of ridges; the retaining barb having a greater outer diameter than the plurality of ridges.

10. The connector of claim 9, wherein the retaining barb has an acute angle.

11. The connector of claim 1, wherein the connector interface is one of type F, N, BNC, SMA, DIN, UHF, CATV, and EIA.

12. The connector of claim 1, wherein the connector interface is coupled to the body by an interference fit into a connector end shoulder in the connector end of the body.

13. The connector of claim 1, wherein the helically corrugated outer conductor and the internal helical groove section have a pair of grooves, each of the grooves oriented 180 degrees away from each other.

14. A connector for coaxial cable having a helically corrugated outer conductor and an inner conductor, comprising:

a connector interface, coupled to a connector end side of a hollow cylindrical body; an inner surface of the body having a cable end shoulder at a cable end side, which is forward of an internal helical groove section which is forward of a stop in the hollow cylindrical body proximate the connector end which extends radically inward; the internal helical groove section and the stop configured to mate with the helically corrugated outer conductor, whereby the body is threadable onto the outer conductor until the outer conductor contacts the stop, a deformation groove between the stop and the internal helical groove section;

a plurality of ridges on an outer surface of the body axially aligned with the internal helical groove section;

a body barb located on the outer surface of the body at the connector end side of the plurality of ridges; the body barb radially protruding from the body; and an inner contact located coaxially within the body, the inner contact having a socket contact section at the cable end side, dimensioned for insertion of the inner conductor and electrical connection therewith.

15. The connector of claim 14, further including a gasket located in the cable end shoulder; the gasket having an internal surface configured to mate with the helical corrugations of the outer conductor.

16. The connector of claim 14, wherein the connector interface is one of a type F, N, BNC, SMA, DIN, UHF, CATV, and EIA.

17. The connector of claim 14, wherein the body barb has a triangular section.

18. The connector of claim 17, further including a portion of heat shrink tubing; the heat shrink tubing applied shrunk about the body, over the body barb.

19. The connector of claim 14, wherein the helically corrugated outer conductor and the internal helical groove section each have mating dual leads.

20. The connector of claim 14, wherein the inner contact is one of beryllium copper, bronze, phosphor bronze and brass.

21. A connector for coaxial cable having a helically corrugated outer conductor and an inner conductor, comprising:

a connector interface, coupled to a connector end side of a hollow cylindrical body; an inner surface of the body having an internal helical groove section at a cable end side, which is forward of a deformation groove which is forward of a stop in the hollow cylindrical body proximate the connector end side which extends radially inward; the internal helical groove section and the stop configured to mate with the helically corrugated outer conductor, whereby the body is threadable onto the outer conductor until the outer conductor contacts a stop, the deformation groove between the stop and the internal helical groove section; and a plurality of ridges on an outer surface of the body axially aligned with the internal helical groove section.

22. The connector of claim 21, further including a cable end shoulder located between the helical groove section and the cable end side, and a gasket located in the cable end shoulder; the gasket having an internal surface configured to mate with the helical corrugations of the outer conductor.

23. The connector of claim 21, wherein the connector interface is one of type F and CATV.

24. The connector of claim 21, wherein the internal helical groove section has a dual lead.

25. A low cost, water-blocking cable-connector system advantageously used with flexible, relatively small diameter coaxial cable and associated connectors, comprising:

a. a coaxial cable comprising:

i. a foam dielectric surrounding an inner conductor; and ii. a tubular outer conductor composed of one of aluminum, and aluminum alloy surrounding the foam dielectric, the outer conductor having helical corrugations penetrating into and compressing the foam dielectric to effectively suppress the formation of fluid migration air gaps or passageways between the outer conductor and the dielectric;

iii. the helical corrugations having a dual lead;

b. a connector, comprising:

i. a connector body having a hollow bore with internal dual lead helical grooves which mate with the helical corrugations of the outer conductor;

ii. the connector body having a spaced series of external, radially extending ridges adapted to be compressed by a connector crimping tool;

iii. the ridges being axially aligned with the internal helical grooves and comprising, in combination with the internal helical grooves, a crimp section of the connector;

iv. the crimp section being sized and configured such that when crimped with a crimping tool, the crimp section deforms inwardly and distorts the cable outer conductor corrugations to prevent relative rotation between the cable and the connector body and thereby to permanently interlock the connector and cable; and c. a resilient gasket to block ingress of moisture into the connector, the gasket having internal helical grooves and adapted to being threaded onto the cable such that when the connector is screwed onto the cable the gasket is sealingly compressed between a cable end shoulder of the connector and the corrugated outer conductor.

26. The system defined by claim 25 wherein the ridges have varying height to control the depth and shape of the crimp.

27. A low cost, water-blocking cable-connector system advantageously used with flexible, relatively small diameter coaxial cable and associated connectors, comprising:

a. a coaxial cable comprising:

i. a foam dielectric surrounding an inner conductor; and ii. a tubular outer conductor composed of one of aluminum and aluminum alloy material surrounding the dielectric, the outer conductor having helical corrugations penetrating into and compressing the dielectric;

b. a connector, comprising:

iii. a connector body having a hollow bore with internal helical grooves which mate with the helical corrugations of the outer conductor;

iv. the connector body having an external area adapted to be compressed by a connector crimping tool;

v. the area being aligned with the internal helical grooves and comprising, in combination with the internal helical grooves, a crimp section of the connector;

vi. the crimp section being sized and configured such that when crimped with a crimping tool, the crimp section deforms inwardly and distorts the cable outer conductor corrugations a prevent relative rotation between the cable and the connector body and thereby to permanently interlock the connector and cable; and d. a resilient gasket configured and positioned to block ingress of moisture into the connector.

28. The system defined by claim 27 wherein the helical outer conductor corrugations and connector internal grooves each have a mating dual lead.

29. The system defined by claim 27 wherein gasket has internal helical grooves and is adapted to being threaded onto the cable such that when the connector is screwed onto the cable, the gasket is sealingly compressed between a capturing section of the connector and the corrugated outer conductor.

30. A low cost, water-blocking cable-connector system advantageously used with flexible, relatively small diameter coaxial cable and associated connectors, comprising:

a. a coaxial cable comprising:

i. a foam dielectric surrounding an inner conductor; and ii. a tubular outer conductor composed of one of aluminum and aluminum alloy material surrounding the foam dielectric, the outer conductor having corrugations penetrating into and compressing the dielectric;

b. a connector, comprising:

i. a connector body having a hollow bore;

ii. the connector body having a crimp section adapted to be compressed by a connector crimping tool;

iii. the crimp section being sized and configured such that when crimped with a crimping tool, the crimp section deforms inwardly and distorts the cable outer conductor corrugations to permanently interlock the connector and cable; and c. a resilient gasket configured and positioned to block ingress of moisture into the connector.

31. The system defined by claim 30 wherein the corrugations are helical and have a single lead.

32. The system defined by claim 30 wherein the corrugations are helical and have a dual lead.

33. The system defined by claim 30 wherein the hollow bore of the connector or body has internal ribs, helical grooves, or other internal perturbations to enhance retention of the connector on the cable.

34. A cable-connector system advantageously used with flexible, relatively small diameter coaxial cable and connectors, comprising:

a. a coaxial cable comprising:

i. a foam dielectric surrounding an inner conductor; and ii. a tubular outer conductor surrounding the foam dielectric, the outer conductor being composed of one of aluminum and aluminum alloy and having helical corrugations; and b. a connector, comprising:

i. a connector body having a hollow bore with internal perturbations keyed to the helical corrugations and configured and arranged to retentively receive and secure the connector on the cable when the connector is screwed onto the cable with the corrugations in engagement with the perturbations;

ii. the connector body having a crimp section adapted to be compressed by a connector crimping tool;

c. the crimp section being sized and configured such that when crimped with a crimping tool, the crimp section deforms inwardly and distorts the cable outer conductor corrugations to prevent relative rotation between the cable and the connector body and thereby to permanently interlock the connector and cable.

35. The system defined by claim 34 wherein the helical corrugations have a dual lead.

36. The system defined by claim 34 wherein the connector body has in the crimp section a spaced series of external, radially extending ridges adapted to be compressed by a standard connector crimping tool.

37. The system defined by claim 36 wherein the ridges are axially aligned with the internal perturbations.

38. The system defined by claim 35, further including a resilient gasket configured and positioned to block ingress of moisture into the connector; the gasket has internal dual lead helical grooves and is adapted to being threaded onto the cable such that when the connector is screwed onto the cable the gasket is sealingly compressed between a cable end shoulder of the connector and the corrugated outer conductor.

39. The system defined by claim 36 wherein the ridges have varying height to control the depth and shape of the crimp.

40. For use with a flexible, relatively small diameter coaxial cable comprising a foam dielectric surrounding an inner conductor, and a tubular outer conductor composed of one of aluminum and aluminum alloy material surrounding the foam dielectric, the outer conductor having helical corrugations penetrating into and compressing the foam dielectric, the helical corrugations having a dual lead, a connector, comprising:

a. a connector body having a hollow bore with internal dual lead helical grooves which mate with the helical corrugations of the outer conductor;

i. the connector body having a spaced series of external, radially extending ridges adapted to be compressed by a connector crimping tool;

ii. the ridges being axially aligned with the internal helical grooves and comprising, in combination with the internal helical grooves, a crimp section of the connector;

iii. the crimp section being sized and configured such that when crimped with a crimping tool, the crimp section deforms inwardly and distorts the cable outer conductor corrugations to prevent relative rotation between the cable and the connector body and thereby to permanently interlock the connector and cable; and b. a resilient gasket to block ingress of moisture into the connector, the gasket having internal helical grooves and adapted to being threaded onto the cable such that when the connector is screwed onto the cable the gasket is sealingly compressed between a cable end shoulder of the connector and the corrugated outer conductor.

41. The system defined by claim 40 wherein the ridges have varying height to control the depth and shape of the crimp.

42. For use with a low cost, flexible, relatively small diameter coaxial cable, comprising a foam dielectric surrounding an inner conductor and a tubular outer conductor composed of one of aluminum and aluminum alloy material surrounding the foam dielectric, the outer conductor having helical corrugations penetrating into and compressing the foam dielectric, a connector, comprising:

a. a connector body having a hollow bore with internal helical grooves which mate the helical corrugations of the outer conductor;

i. the connector body having an external area adapted to be compressed by a connector crimping tool;

ii. the area being aligned with the internal helical grooves and comprising, in combination with the internal helical grooves, a crimp section of the connector;

iii. the crimp section being sized and configured such that when crimped with a crimping tool, the crimp section deforms inwardly and distorts the cable outer conductor corrugations to prevent relative rotation between the cable and the connector body and thereby to permanently interlock the connector and cable; and b. a resilient gasket to configured and positioned to block ingress of moisture into the connector, the gasket being sealingly compressed between a cable end shoulder of the connector and the corrugated outer conductor.

43. The connector defined by claim 42 wherein the helical outer conductor corrugations and connector internal grooves each have a mating dual lead.

44. The connector defined by claim 42 wherein the gasket has internal helical grooves and is adapted to being threaded onto the cable such that when the connector is screwed onto the cable, the gasket is sealingly compressed between a cable end shoulder of the connector and the corrugated outer conductor.

45. For use with a flexible, relatively small diameter coaxial cable comprising a foam dielectric surrounding an inner conductor and a tubular outer conductor surrounding the foam dielectric, the outer conductor being composed of one of aluminum and aluminum alloy and having helical corrugations, a connector, comprising:

a. a connector body having a hollow bore with internal perturbations keyed to the helical corrugations and configured and arranged to retentively receive and secure the connector on the cable when the connector is screwed onto the cable with the corrugations in engagement with the perturbations;

i. the connector body having a crimp section adapted to be compressed by a connector crimping tool;

ii. the crimp section being sized and configured such that when crimped with a crimping tool, the crimp suction deforms inwardly and distorts the cable outer conductor corrugations to prevent relative rotation between the cable and the connector body and thereby to permanently interlock the connector and cable; and b. a resilient gasket configured and positioned to block ingress of moisture into the connector, the gasket being sealingly compressed between a cable end shoulder of the connector and the corrugated outer conductor.

46. The connector defined by claim 45 wherein the helical corrugations have a dual lead.

47. The connector defined by claim 45 wherein the connector body has in the crimp section a spaced series of external, radially extending ridges adapted to be compressed by a standard connector crimping tool.

48. The connector system defined by claim 47 wherein the ridges are axially aligned with the internal perturbations.

49. The connector defined by claim 45 wherein the gasket has internal dual lead helical grooves and is adapted to being threaded onto the cable such that when the connector is screwed onto the cable the gasket is sealingly compressed between a cable end shoulder of the connector and the corrugated outer conductor.

50. The connector defined by claim 47 wherein the ridges have varying height to control the depth and shape of the crimp.

51. A water resistant cable and connector system, comprising:

a coaxial cable, comprising:

a center conductor, surrounded by a dielectric, surrounded by a tubular dual lead helically corrugated outer conductor;

the center conductor and the outer conductor formed from one of aluminum and an aluminum alloy; and a connector, comprising:

a connector interface, coupled to a connector end of a hollow cylindrical body; an inner surface of the body having an internal dual lead helical groove section at a cable end, adjacent a stop proximate the connector end which extends radially inward; the internal dual lead helical groove section and the stop configured to mate with the dual lead helically corrugated outer conductor, whereby the body is threaded onto the outer conductor until the outer conductor contacts the stop; and a plurality of ridges on an outer surface of the body axially aligned with the internal dual lead helical groove section;

the plurality of ridges dimensioned to be crimped by a hand crimp tool capable of deforming the internal dual lead helical groove section and a corresponding section of the outer conductor, thereby interlocking the coaxial cable and the connector.

52. The system of claim 51, further including a gasket mounted between a cable end shoulder located at a cable end of the connector and the corrugated outer conductor.

53. The system of claim 52, wherein the gasket has an internal surface configured to mate with the dual lead helically corrugated outer conductor.

54. The system of claim 51, further including a deformation groove between the stop and the helical groove section.

55. The system of claim 51, wherein the helical groove section is a plurality of internal protrusions which engage the dual lead helically corrugated outer conductor.

56. A water resistant cable and connector system, comprising:

a coaxial cable, comprising:

a center conductor, surrounded by a dielectric, surrounded by a tubular dual lead helically corrugated outer conductor, the outer conductor formed from one of aluminum and an aluminum alloy; and a connector, comprising:

a connector interface, coupled to a connector end of a hollow cylindrical body; an inner surface of the body having a mating section at a cable end, adjacent a stop proximate the connector end which extends radially inward; the mating section and the stop configured to mate with the dual lead helically corrugated outer conductor, whereby the outer conductor is inserted into the mating section until the outer conductor contacts the stop; and a plurality of outer ridges on an outer surface of the body axially aligned with the mating section;

the plurality of ridges dimensioned to be crimped by a hand crimp tool capable of deforming the mating section and a corresponding section of the outer conductor, thereby interlocking the coaxial cable and the connector.

57. The system of claim 56, further including a gasket mounted between a cable end shoulder located at the cable end of the connector and the corrugated outer conductor.

58. The system of claim 56, wherein the gasket has an internal surface configured to mate with the dual lead helically corrugated outer conductor.

59. The system of claim 56, wherein the mating section is a plurality of ridges that extend radially inward.

60. The system of claim 56, wherein the mating section is a plurality of axial ridges that extend radially inward.

61. The system of claim 56, wherein the mating section is a plurality of wedge shaped ridges that extend radially inward.

62. The system of claim 56, further including a deformation groove between the stop and the helical groove section.

63. The system of claim 62, wherein the mating section is a plurality of ridges that extend radially inward.

64. The system of claim 62, wherein the mating section is a plurality of axial ridges that extend radially inward.

65. The system of claim 62, wherein the mating section is a plurality of wedge shaped ridges that extend radially inward.

66. The system of claim 56, wherein the coaxial cable has a characteristic impedance of about 75 ohms.

* * * * *